US005598974A

United States Patent [19]

Lewis et al.

[11] Patent Number: 5,598,974

[45] Date of Patent: Feb. 4, 1997

[54] REDUCED CAVITY MODULE WITH INTERCHANGEABLE SEAT

[75] Inventors: William A. Lewis, Lilburn; Edward C. Taylor, Cumming, both of Ga.

[73] Assignee: Nordson Corporation, Westlake, Ohio

[21] Appl. No.: 372,607

[22] Filed: Jan. 13, 1995

[51] Int. Cl.[6] ..... B05B 1/02

[52] U.S. Cl. ..... 239/135; 239/533.15; 239/584; 251/360; 137/315

[58] Field of Search ..... 239/135, 533.1, 239/533.15, 583, 584, 600; 251/63.5, 360; 137/315

[56] References Cited

U.S. PATENT DOCUMENTS

| | | | |
|---|---|---|---|
| Re. 33,481 | 12/1990 | Ziecker et al. | 239/298 |
| 2,051,210 | 8/1936 | Gustafsson | 239/140.1 |
| 2,101,175 | 12/1937 | Gustafsson | 239/140.1 |
| 3,004,719 | 10/1961 | Pouppirt, Jr. | 239/381 |
| 3,053,461 | 9/1962 | Inglis | 239/411 |
| 3,252,657 | 5/1966 | Winegar | 239/296 |
| 3,329,347 | 7/1967 | Montgomery | 239/583 |
| 3,348,520 | 10/1967 | Lockwood | 118/2 |
| 3,507,589 | 4/1970 | Keller | 431/126 |
| 3,543,332 | 12/1970 | Wagner et al. | 18/8 |
| 3,556,411 | 1/1971 | Nord et al. | 239/581 |
| 3,668,869 | 6/1972 | De Corso et al. | 60/39.74 R |
| 3,690,518 | 9/1972 | Baker et al. | 222/504 |
| 3,764,069 | 10/1973 | Runstadler, Jr. et al. | 239/8 |
| 3,840,158 | 10/1974 | Baker et al. | 222/487 |
| 3,841,567 | 10/1974 | Drozek et al. | 239/570 |
| 3,923,252 | 12/1975 | Warning, Sr. et al. | 239/411 |
| 4,171,096 | 10/1979 | Welsh et al. | 239/291 |
| 4,219,157 | 8/1980 | Binoche | 239/296 |
| 4,334,637 | 6/1982 | Baker et al. | 222/146 |
| 4,349,947 | 9/1982 | Rood | 29/157 C |
| 4,360,132 | 11/1982 | Vilagi et al. | 222/504 |
| 4,465,212 | 8/1984 | Boone | 222/504 |
| 4,579,255 | 4/1986 | Frates et al. | 222/149 |
| 4,732,364 | 3/1988 | Seger et al. | 251/360 |
| 4,785,996 | 11/1988 | Ziecker et al. | 239/298 |
| 4,801,051 | 1/1989 | Lewis et al. | 222/309 |
| 4,815,660 | 3/1989 | Boger | 239/8 |
| 4,891,249 | 1/1990 | McIntyre | 427/421 |
| 4,907,741 | 3/1990 | McIntyre | 239/124 |
| 4,911,956 | 3/1990 | Gabryszewski et al. | 427/424 |
| 4,969,602 | 11/1990 | Scholl | 239/298 |
| 5,020,723 | 6/1991 | Crist | 239/11 |
| 5,065,943 | 11/1991 | Boger et al. | 239/298 |
| 5,169,071 | 12/1992 | Boger et al. | 239/296 |
| 5,194,115 | 3/1993 | Ramspeck et al. | 156/578 |
| 5,292,068 | 3/1994 | Raterman et al. | 239/11 |
| 5,336,320 | 8/1994 | Hogan et al. | 239/584 |

FOREIGN PATENT DOCUMENTS 1587898 4/1981 United Kingdom .

OTHER PUBLICATIONS

"Series H200 Reduced Cavity Guns", 1993 Nordson Corporation, PKL–93–354 Issued Jan. 1993.

"1994 Adhesives and Sealants Equipment Catalog" published by Nordson Corporation 1992, 1993 and 1994.

*Primary Examiner*—Andres Kashnikow
*Assistant Examiner*—Lisa Douglas
*Attorney, Agent, or Firm*—Wood, Herron & Evans, P.L.L.

[57] ABSTRACT

A nozzle assembly (11) of an adhesive dispensing valve (10) includes a first valve (32) adjacent a discharge orifice (34). The first valve (32) opens to permit the flow of adhesive therethrough and closes to terminate the flow of adhesive in response to respective first and second states of the valve operating module (14). The adhesive dispensing valve (10) has a separable nozzle plate (102) that includes the first valve seat (100) and the discharge orifice (34) and is coupled to a nozzle body (72) with a mounting cap (104). A secondary valve (146) is located upstream of the first valve (32) and permits adhesive to flow therethrough in response to both of the first and second states of the valve operating module. However, as the mounting cap (104) and nozzle plate (102) are removed, the secondary valve (146) automatically engages its valve seat (94), thereby terminating the flow of adhesive while the nozzle plate (102) is removed from the valve body (16).

25 Claims, 2 Drawing Sheets

REDUCED CAVITY MODULE WITH INTERCHANGEABLE SEAT

FIELD OF THE INVENTION

This invention relates to the application of liquids to surfaces and especially to equipment used to apply beads, ribbons, or small deposits of extruded or sprayed material in a desired pattern under high speed production conditions. More particularly, the invention relates to equipment which is suitable for applying heated liquids, such as "hot melt" molten adhesives to various materials, such as flat sheets, webs of paper, or cardboard of the type commonly used in packaging and, in addition, adhering a variety of products. The invention, though, is equally applicable to the application of other liquid materials, such as coating materials.

BACKGROUND OF THE INVENTION

Examples of some hot melt applicator systems are disclosed in the Baker, et al., U.S. Pat. Nos. 3,690,518 and 3,840,158, as well as in Frates et al., U.S. Pat. No. 4,579,255, all of which are assigned to the assignee of the present invention. In these and some prior art hot melt applicator systems, the qualitative responsiveness of the system in terms of the applied bead consistency, bead width, bead placement, bead edge quality, etc. may deteriorate at the end of the bead.

In order to provide further precision to the adhesive dispensing process, the Lewis, et al. U.S. Pat. No. 4,801,051 which is assigned to the assignee of the present invention, discloses a similar fluid dispensing valve in which a new valve stem guide is used. In addition, a device for fine adjustment of the maximum travel of the valve stem accurately and adjustably controls the flow of liquid through the nozzle opening. While this design improved the performance of the adhesive dispensing valve in certain applications, some adhesive continues to collect in the dispensing channel after valve closure.

With the above described systems, the valve seat, discharge orifice, and dispensing channel therebetween are all an integral part of the nozzle body, which is mounted with fasteners to the valve operating module. Consequently, with this and some other prior art systems, if it is desired to change the size of the discharge orifice, or if the orifice becomes clogged, it is necessary to remove the fasteners and the entire nozzle body in order to flush the system and manually clean the discharge channel and orifice only after the fluid pressure of the hot melt adhesive has been removed from the dispenser. If the adhesive being dispensed is a hot melt adhesive, the adhesive will generally be maintained at a temperature within the range of about 250° F. to about 425° F.; and therefore, the handling of hot valve components on disassembly and flushing the valve with the hot melt adhesive must be done very carefully.

In addition, after the valve is cleaned, it is cold and reassembling the cold nozzle body to the valve operating module, which contains the hot melt adhesive, will result in a premature hardening of the adhesive upon its initial contact with the cold nozzle body. Such cooling increases the risk of clogging of the dispensing valve. To avoid that premature cooling, auxiliary heating elements or heat guns are used to heat the cold nozzle body and the adhesive in contact therewith. Consequently, there is a disadvantage with the above in that the process of changing and cleaning the dispensing nozzle is complicated and may shut down a production line for more than one hour.

There are nozzle designs in which a nozzle plate containing the discharge orifice is secured to a valve by a mounting nut such as that shown in Vilagi et al. U.S. Pat. No. 4,360,132, assigned to the assignee of the present invention. However, none of the nozzle plates that are held on with a mounting nut and can be quickly removed contain the dispensing valve seat and its connecting dispensing channel. Therefore, with those designs, the valve seat and the dispensing channel cannot be readily cleaned or exchanged without disassembling of the dispensing valve.

Further, even though the dispensing channel in newer valve designs is to a great extent self-cleaning, small amounts of adhesive may still remain in the dispensing channel after the valve is closed. This remaining adhesive may harden and form one or more small chips or particles which may adversely affect subsequent dispensing cycles. For example, during the start of a subsequent cycle, the trajectory of those particles of adhesive is unknown and unpredictable. Further, the hardened particles may stay in the dispensing channel and deflect a subsequent adhesive stream. Consequently, all of the above designs have the disadvantage that some adhesive remains in the dispensing channel and is not subject to adhesive dispensing process control.

In the above designs, the valve seat, the dispensing channel, and the discharge orifice are all located at one end of the relatively long and narrow nozzle body and must be machined by obtaining access through the opposite end of the centrally located and relatively narrow adhesive cavity within the nozzle body. A disadvantage of those designs is that the machining of the valve seat, dispensing channel and discharge orifice is a complex and expensive process.

Finally, in some applications, newer adhesive formulations are more chemically aggressive and corrosive than previous adhesives. Further, the corrosion resistant materials from which the adhesive dispensing valve must be made are typically more exotic or expensive and more difficult to manufacture. This may require that the whole nozzle body, including the nozzle section, must be made from the more expensive material if it is physically or economically feasible.

SUMMARY OF THE INVENTION

To overcome the disadvantages described above, the present invention provides an adhesive dispensing valve in which the dispensing valve seat, dispensing orifice and discharge orifice may be removed without disassembling the nozzle body and with minimal leakage of the hot melt adhesive. Further, the valve seat, dispensing orifice and discharge orifice are less complicated and less expensive to manufacture. Therefore, the invention is particularly suited for those applications where an adhesive is used which has a tendency to clog or which is especially corrosive.

According to the principles of the present invention and in accordance with the described embodiments, an adhesive dispensing valve has a separable nozzle plate that includes the dispensing valve seat, the discharge orifice and the dispensing channel therebetween. The separable nozzle plate is coupled to the nozzle body with a mounting cap. Therefore, an advantage of the above design that the nozzle plate may be easily removed from the nozzle body by simply removing the mounting cap holding the nozzle plate on to the nozzle body. The nozzle plate may be removed and may be reinstalled in a few minutes versus up to an hour with the prior art designs.

In a further embodiment, the adhesive dispensing valve includes a secondary valve which blocks the flow of adhesive when the mounting cap and nozzle plate are removed from the nozzle body. The adhesive dispensing valve includes a dispensing valve at the end of the dispensing channel opposite the discharge orifice. The dispensing valve opens to permit the flow of adhesive therethrough and closes to terminate the flow of adhesive in response to respective first and second states of the valve operating module. The adhesive dispensing valve also has a secondary valve located between the dispensing valve and the open end of the valve operating module. The secondary valve permits adhesive to flow therethrough in response to both of the first and second states of the valve operating module. However, as the mounting cap and nozzle plate are removed, the secondary valve automatically engages its respective valve seat in response to the mounting cap and nozzle plate being moved in a direction away from the nozzle body. Therefore, this embodiment of the invention has the further advantage of blocking the flow of adhesive as the cap nut is loosened prior to removal of the nozzle plate.

In a further aspect of the invention, the secondary valve has a valve stem that has an upper section operatively connected to the valve operating module and a lower section having a cross-section smaller than the cross-section of the upper section. The upper and lower sections are joined by a transitional section which has a continuous curvilinear outer surface. The curvilinear longitudinal profile of the transitional section has the advantage of optimizing the flow of adhesive therethrough during the normal operation of the primary dispensing valve. However, when the nozzle plate is removed, the curvilinear surface functions with its corresponding valve seat as a ball-type valve with the advantage of providing an excellent seal for blocking the adhesive when the nozzle plate is being removed.

In a further embodiment of the invention, the nozzle plate consists of a generally cylindrical body which has a first conically shaped cavity with a wider end directed toward an upper side of the body. The first conically shaped cavity is adapted to receive the valve stem. The nozzle plate also includes a second conically shaped cavity having a wider end intersecting the narrower end of the first cavity, the second cavity has a narrower end terminating into the dispensing channel. The nozzle plate also has a mounting flange with an upper side contiguous with the upper side of the nozzle plate body. The mounting flange has a downwardly extending annular projection from its lower side which engages the mounting cap and provides a seal therebetween.

In a still further embodiment of the invention, the nozzle body has a blind hole or bore extending into the lower end of the nozzle body. When the nozzle plate is inserted into the bore, the conically shaped lower end of the valve stem is received by and mates with second conically shaped cavity in the nozzle plate. The nozzle plate has a periphery smaller than the periphery of the bore and, therefore, the nozzle plate may slide on the end surface of the bore in a direction generally perpendicular to a longitudinal axis of the valve stem. When the mounting cap initially engages the mounting flange on the nozzle plate, the nozzle plate is loosely disposed in the bore of the nozzle body and free to slide therein as the conical end of the valve stem engages the mating second conical cavity in the nozzle plate. Therefore, the smaller periphery of the nozzle plate allows it to move to a concentric position with respect to the valve stem, thereby advantageously centering itself as the mounting cap is tightened onto the nozzle body. A continued tightening of the mounting cap secures the nozzle plate to the nozzle body in the desired concentric location.

In addition, the nozzle body and the dispensing channel of the adhesive dispensing valve is physically smaller than the valves of the prior art. Consequently, it is believed that the adhesive dispensing valve of the present invention has the advantage of providing better qualitative response characteristics; and the applied bead consistency, bead width, bead placement, bead edge quality, etc. are improved with the present invention.

As a further advantage, the separable nozzle plate provides ready access to the dispensing valve seat, the discharge channel, and the dispensing channel extending therebetween. Consequently, the machining of the nozzle plate is substantially easier and less expensive than the prior art nozzle bodies.

An additional advantage of the separable nozzle plate is that if corrosive adhesives are used, which require an exotic and expensive material in contact with the adhesive, only the nozzle plate need be made of that material. The associated mounting cap can be made from more standard, less expensive materials. These and other objects and advantages of the present invention will become more readily apparent during the following detailed description, together with the drawings herein.

DETAILED DESCRIPTION OF THE INVENTION

Figure 1:
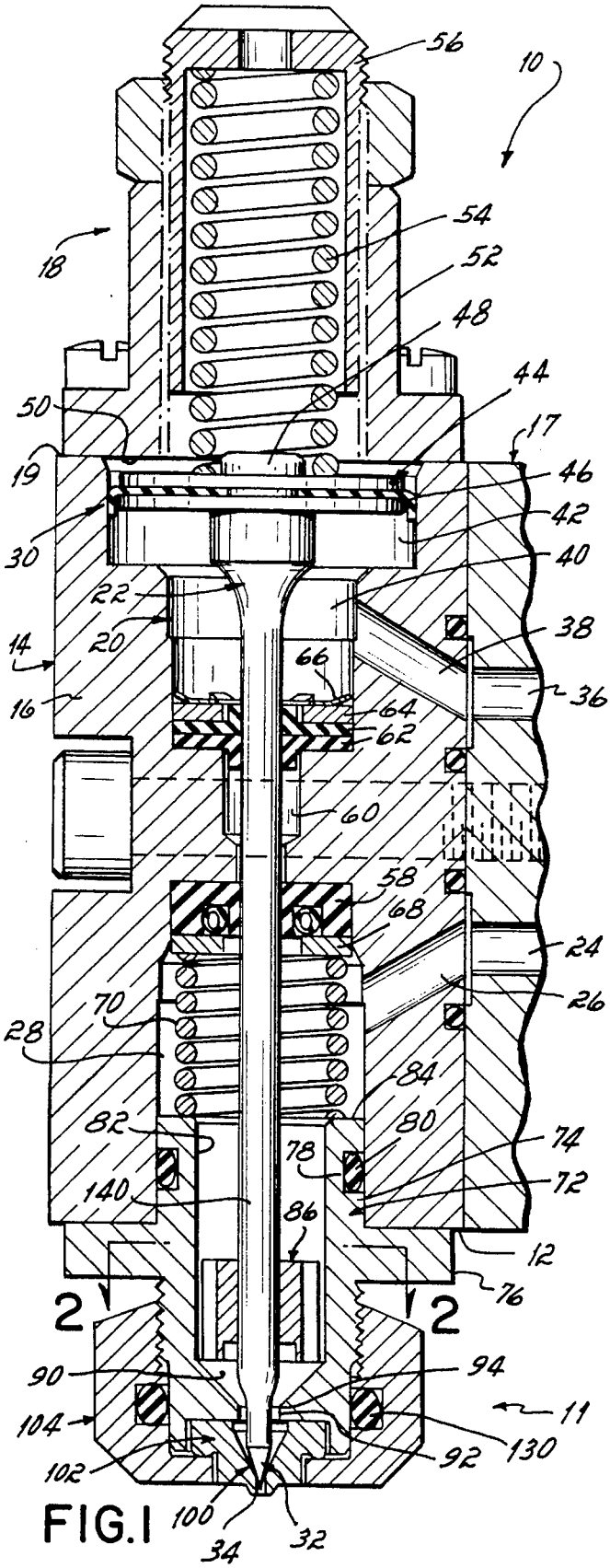
FIG. 1 is a cross sectional view of a dispensing apparatus incorporating the dispensing valve of the present invention.

The dispensing valve of the present invention as illustrated in FIG. 1 is implemented within a fluid dispensing apparatus or gun 10 that includes a nozzle assembly 11 connected to one end 12 of a valve operating module 14. The valve operating module 14 has a main body 16 connected to a manifold 17, and a flow adjuster 18 is connected to the other end 19 of the valve operating module 14. A central longitudinal bore 20 extends through the flow adjuster 18, the body 16 and the nozzle assembly 11. A hot melt adhesive or fluid supply passage 24 extends through the manifold 17 and intersects a fluid passageway 26 in the body 16 that carries fluid into a fluid cavity 28 defined by central bore at the one end 12 of the valve body 16.

A pneumatic solenoid 30 is actuated by pressurized air ported through a pressurized air supply passage 36 within the manifold 17. An air passageway 38 extends between the air passage 36 and an air cavity 40 which in turn intersects one end of the air cylinder 42 of the solenoid 30. A piston 44 within the pneumatic solenoid 30 is disposed within the air cylinder 42 and has a piston ring or seal 46 that provides a pneumatic seal while the piston 44 slides within the air cylinder 42. The seal 46 is preferably made from "RULON A" seal material commercially available from Dixon Industries of Bristol, R.I. The piston 44 has a center hole which receives one end of the valve stem 22 so that the center lines of the piston 44 and valve stem 22 are substantially coaxial. A fastener 48 is used to secure the one end of the valve stem to the piston 44.

When a fluid dispensing cycle is to be initiated, pressurized air is supplied through the air passages 36, 38 into the cavity 40 and cylinder 42 thereby applying a force against the piston 44 to move it in a vertically upward direction, as illustrated in FIG. 1, against a lower surface 50 of end cap 52. Moving the piston 44 upward also moves the valve stem 22 upward, thereby opening the dispensing valve 32 and discharging a bead of hot melt adhesive from the adhesive cavity 28 through the orifice 34. When the fluid dispensing cycle is to be ended, the supply of pressurized air is removed from the passageway 36 of manifold 17, and the compression spring 54 moves the piston 44 and valve stem 22 in a vertically downward direction, as illustrated in FIG. 1, thereby closing the dispensing valve 32. An adjusting screw 56 is used to adjust the closing force applied by the compression spring 54 which in turn changes the maximum frequency or the rate of operation of the dispensing valve 32.

The adhesive cavity 28 is isolated from the air cavity 40 by means of a commercially available spring loaded lip seal 58. The lip seal 58 is held in place by a metal washer 68 and compression spring 70. The lip seal 58 is constructed to provide inner directed radial forces against the valve stem 22 thereby preventing the hot melt adhesive from leaking past the valve stem from the adhesive cavity 28. In the event that some adhesive does escape past the lip seal 58, it accumulates in a cavity 60 formed between the walls of a longitudinal bore 20 and valve stem 22 and bleeds through a radial weep hole (not shown) connecting the cavity 60 with the exterior of the valve body 16. The cavity 60 is sealed from the air cavity 40 by a pair of seals 62 which are held in place by a metal washer 64 and a retainer spring 66.

Figure 2:
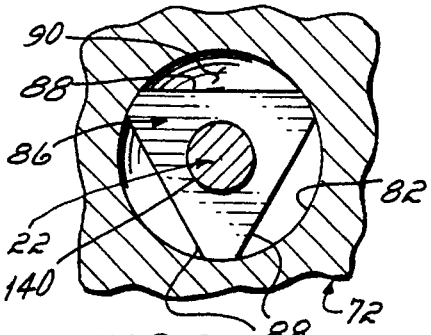
FIG. 2 is a cross sectional view taken along line 2—2 of FIG. 1 and illustrates the triangular shape of the valve stem guide.
Figure 4:
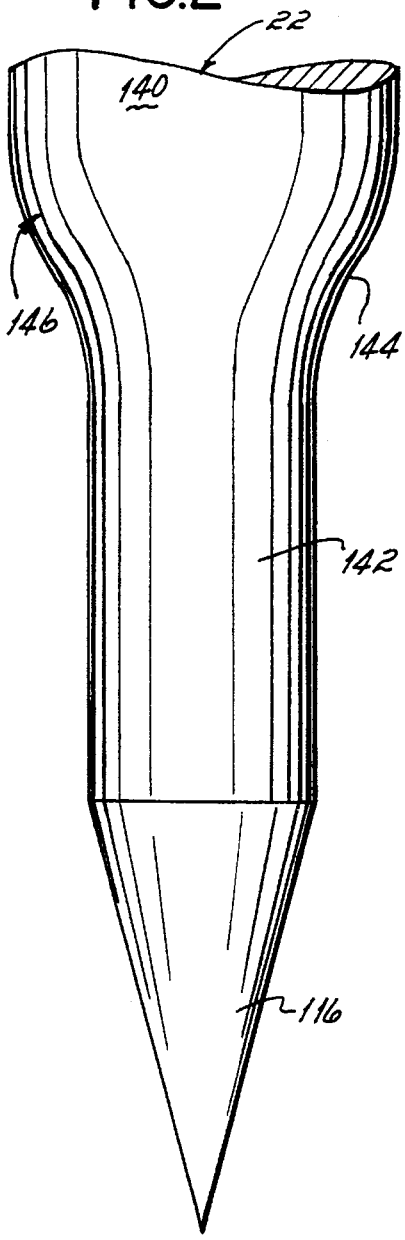
FIG. 4 is a partial prospective view illustrating the shape of one end of the valve stem.

The nozzle assembly 11 includes a nozzle body 72 which is mounted on the one end 12 of the valve operating module 14. The nozzle body 72 includes a shaft 74 having a first end extending into the adhesive cavity 28. The nozzle body 72 further includes a mounting flange 76 located between the ends of the shaft 74. The mounting flange 76 is used to secure the nozzle body 72 and nozzle assembly 11 to the body 16 by cap screws or other fasteners (not shown). When the nozzle body 72 is mounted onto the one end 12 of the valve operating module 11, the end 84 of the nozzle body 72 contacts and compresses the compression spring 70 thereby applying a retaining force against the washer 68 and the lip seal 58 to hold them in their desired positions. The shaft 74 has a circumferential groove 78 in which is disposed a seal or O-ring 80 to prevent the hot melt adhesive from leaking between the walls of the adhesive cavity 28 and the outer surface of the shaft 74 of the nozzle body 72. The nozzle body 72 includes a centrally located longitudinal bore 82 extending from one end 84 of the nozzle body 72. A valve stem guide 86 disposed within the bore 82 and, as shown in FIG. 2, is triangularly shaped to hold the valve stem 22 coaxial with the center line of the bore 82. Therefore, hot melt adhesive is free to flow from the adhesive cavity 28 through the bore 82 and through passages formed by the sides 88 of the valve guide 86 and into a conical-shaped cavity 90 the wider end of which intersects the bore 82. The narrow end of the conical cavity 90 intersects a cylindrical bore 92 to form a substantially circular edge 94.

In the very early nozzle designs, the lower end of the valve stem contained a spherical shape which formed a ball valve with the substantially circular edge 94. In later designs the cylindrical bore is tapered to mate with the needle taper on the end of the valve stem 22 thereby forming a needle valve. In contrast to those prior designs, the present invention provides a dispensing valve formed between a dispensing valve seat 100 which is formed in a nozzle insert, or plate, 102 that is mounted on the nozzle body 72 by means of a mounting cap 104.

Figure 5:
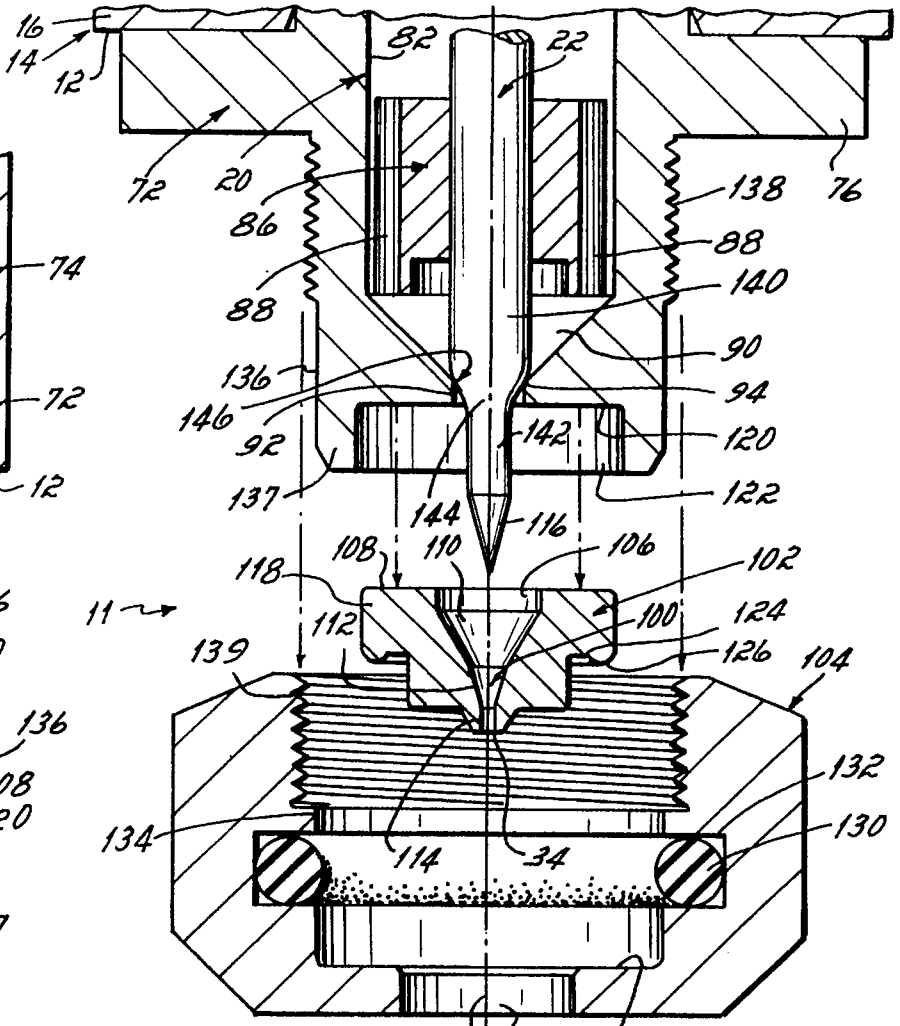
FIG. 5 is a cross sectional view of a disassembled fluid dispensing valve which operatively closes the secondary valve.
Figure 3:
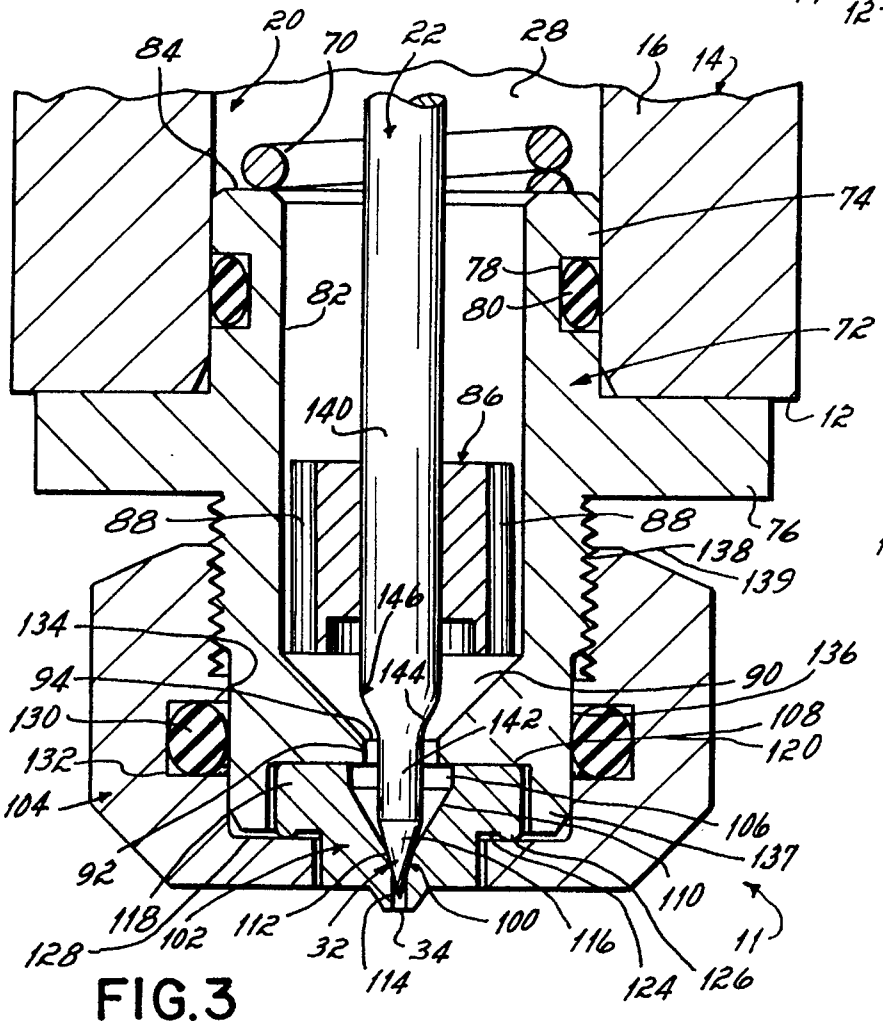
FIG. 3 is a cross sectional view of an assembled dispensing valve which holds the secondary valve in an open position.

Referring to FIGS. 3 and 5, the nozzle plate 102 has a first bore 106 that intersects one side 108 of the nozzle plate 102. A first conically-shaped cavity 110 has a wider end intersecting one end of the first bore 106 and is sized to receive the hot melt adhesive and the valve stem 22. A second conically-shaped cavity 112 has a wider end intersecting a narrower end of the first conically-shaped cavity 110. A dispensing channel 114 extends between a narrower end of the second conically-shaped cavity 112 and the dispensing orifice 34. The second conically-shaped cavity 112 receives and mates with a conical body section 116 of valve stem 22 having an outer conical surface which mates with an inner directed surface, or needle valve seat, formed by the second conically-shaped cavity 112. Therefore, the conically body section 16 of the valve stem 22 cooperates with the second conically shaped cavity 112 of the nozzle plate 102 to form a needle valve which is the dispensing valve 32.

The nozzle plate 102 further includes a disc-shaped mounting flange 118 that extends generally in the direction perpendicular to the longitudinal axis of the valve stem 22. The mounting flange has an upper side as viewed in FIGS. 3 and 5, which is contiguous with the one side 108 of the nozzle plate 102 and contacts a bottom surface 120 of a nozzle plate receiving cavity 122 disposed within the second end of the shaft 74 of the nozzle body 72. The nozzle plate receiving cavity 122 circumferential is preferably cylindrical and has a circumference or perimeter slightly larger than the circumference or perimeter of the disk-shaped or cylindrical flange 118. The opposite side 124, or lower side of the mounting flange 118, has an outer directed annular lip or projection 126 extending in a vertically downward direction. The lip 126 engages an inner surface 128 of the mounting cap 104 and provides an area for concentrating the forces provided by the mounting cap to secure the nozzle plate 102 in position as viewed in FIGS. 3 and 5. In addition, the annular lip 126 operates as a seal between the nozzle plate 102 and the mounting cap 104. A further seal is provided by an O-ring 130 disposed in a circumferential groove 132 on an inner cylindrical surface 134 of the mounting cap 104. The cylindrical surface 134 is substantially parallel to the centerline of the valve stem 22. The O-ring 130 sealingly engages a bearing surface 136 that extends longitudinally from the other end 137 of the shaft 74 of the nozzle body 72 and is directly opposite the cylindrical surface 134 of the mounting cap 104. The shaft 74 of the nozzle body 72 has threads 138 extending longitudinally between the surface 136 and the mounting flange 76. The threads 138 on the shaft 74 engage mating threads 139 on the mounting cap nut. The threads 138, 139 are effective to couple and tighten the mounting cap 104 onto the shaft 74 of the nozzle body 72, thereby securing the mounting plate 102 in its desired position within the nozzle body 72.

The needle valve 22 has a first generally cylindrical body section 140 that extends generally over a substantial length of the valve stem 22. A second generally cylindrical body section 142 has a diameter that mates with the larger end of the conical body section 116 and is smaller than the diameter of the first generally cylindrical body section 140. Therefore, the cross-section and perimeter of the second body section 142 are smaller than the cross-section and perimeter of the first body section 140. The valve stem 22 further includes a transitional body section 144 that has a continuous curvilinear surface joining the outer surfaces of the first and second body sections 140, 142, respectively. The transitional body section 144 is formed to mate with the circular intersecting line 94 functioning as a second valve seat to form a ball valve 146.

In normal operation the assembled nozzle assembly 11 is shown as illustrated in FIG. 3 in which when the dispensing valve 32 is closed, the ball valve 146 formed by the section 144 of the valve stem 22 and the second valve seat 94 is held open. Further, the transitional section 144 of the valve stem 22 is formed to maximize the flow of hot melt adhesive through the open ball valve 146 when the dispensing valve 32 is open. If the dispensing valve 32 becomes clogged or it is otherwise desired to clean dispensing valve 32, the mounting cap 104 is rotated in a first direction, for example, a counterclockwise direction, to loosen or remove the mounting cap 104 from the stationary nozzle body 72. That rotation, of the nozzle cap 104 will move the nozzle cap 104, nozzle plate 102, and valve stem 22 in a vertically downward direction as viewed in FIG. 3. As loosening of the mounting cap 104 continues, the body section 144 of the valve stem 22 engages the second valve seat 94 thereby closing the ball valve 146, as shown in FIG. 5. With the ball valve 146 closed, the flow of hot melt adhesive is stopped. As the cap nut 104 is further loosened, the mounting cap nut 104 and nozzle plate 102 continue to move vertically downward; but the valve stem remains in a stationary position within the valve seat 94. The mounting cap nut 104 and nozzle plate 102 are then removed from the nozzle body 72 thereby permitting those components and the valve stem section 116 comprising the dispensing valve 32 to be thoroughly cleaned. Further, that cleaning process may be accomplished without having hot melt adhesive falling from the adhesive cavity 28. Therefore, the dispensing valve 32 may be easily and quickly cleaned with minimal leakage and direct contact with the hot melt adhesive itself. In addition, after being cleaned, those thermally cooled components may be reassembled to the nozzle body 72 without premature cooling of the hot melt adhesive.

The assembly process is the reverse of the disassembly process. The nozzle plate 102 is dropped into the cap nut 104 such that the nozzle plate body extends through the end hole 150 of the mounting cap nut 104. The mounting cap nut is then screwed onto the threads 138 of the nozzle body 72 by rotating the cap nut in an opposite, for example, the clockwise, direction. That action is effective to move the cap nut 104 and the nozzle plate 102 in the vertically upward direction as viewed in FIGS. 3 and 5. In that process, the nozzle plate 102 moves into the cavity 122 of the nozzle body 72. In addition, the conical body section 116 of the valve stem 22 engages the second conically-shaped cavity 112 of the nozzle plate 102. Because the diameter, or perimeter, of the flange 118 of the nozzle plate 102 is smaller than the diameter or perimeter of the cavity 122, the nozzle plate 102 is free to move in a direction generally perpendicular to the centerline 151 of the valve stem 22 thereby permitting the centerline of the second conically-shaped cavity 112 to exactly coincide with the centerline 151 of the conical body section 116 and valve stem 22. Therefore, as the mounting cap nut 104 and nozzle plate 102 are mounted onto the nozzle body 72, the nozzle plate 102 which contains the dispensing valve seat within conical section 112 is selfaligning with the needle valve stem 116 on the valve stem 22. Consequently, the mating valve stem 116 and seat 112 sections of the dispensing valve 32 are automatically aligned in the assembly process, thereby facilitating the desired precise operation of the dispensing valve 32.

While the invention has been set forth by a description of the embodiment in considerable detail, it is not intended to restrict or in any way limit the claims to such detail. Additional advantages and modifications will readily appear to those who are skilled in the art. For example, the valve stem section 144 and associated second valve seat 94 are preferably made to form the ball valve 146; however, other valve configurations may be used which are effective to terminate the flow of adhesive as the mounting cap is removed. Further, the nozzle plate 102 and its receiving cavity 122 are preferably circular; however, the nozzle plate 102 and cavity 122 may alternatively have a square, hexagonal, octagonal, or other shaped perimeter. In addition, while preferably the nozzle plate has a perimeter that is smaller than that of its receiving cavity so that the nozzle plate may self-align as it is mounted onto the nozzle body, it will be appreciated that the machining tolerances may be specified such that the nozzle plate may be manufactured as an integral part of the mounting cap 104. In addition, the mounting cap 104 is preferably threaded onto the nozzle body 72; however, other known coupling mechanisms may be used to releasably secure the mounting cap 104 to the nozzle body 72. Further, while a first cylindrical bore 106 of nozzle plate 102 is illustrated between the side 108 of the nozzle plate and the first conically-shaped cavity 110, the conically-shaped cavity 110 may extend out directly to intersect the side 108 of the nozzle plate or a different intermediate connecting channel may be provided. Accordingly, departures may be made from the details described herein without departing from the spirit and scope of the invention.

What is claimed is:

1. An adhesive dispensing valve adapted to be mounted on a valve operating module having an adhesive passageway providing a fluid path between the valve and a supply of adhesive, the adhesive dispensing valve controlling the flow of adhesive through the valve in response to operative states of the operating valve module, the adhesive dispensing valve comprising:

a body having a first end adapted to be connected to the valve operating module, an opposing second end, an adhesive passage extending through the body between the first and the second ends, and a cavity extending from the second end into the body; and a valve stem extending through the adhesive passage in the body and having a first end adapted to be connected to the valve operating module, the valve stem having a conically shaped second end;

a plate disposed within the cavity of the body, the plate having a conically shaped central passage for receiving and mating with the conically shaped second end of the valve stem, a periphery smaller than a periphery of the cavity thereby permitting the nozzle plate to slidably move within the cavity in a direction generally perpendicular to a longitudinal axis of the valve stem, and a mounting flange; and a cap engaging the mounting flange of the plate and releasably attached to the body, whereby initially moving the cap into engagement with the mounting flange so that the plate is loosely disposed within the cavity of the body moves the conically shaped second end of the valve stem into the conically shaped central passage of the plate, thereby bringing the plate into a concentric relationship with respect to the valve stem, and whereby further moving the cap into engagement with the mounting flange tightly secures the plate in the cavity of the body in the concentric relationship with the valve stem.

2. The adhesive dispensing valve of claim 1 wherein the periphery of the plate forms a gap with the periphery of the cavity in the range of approximately 0.28 mm to approximately 0.54 mm.

3. An adhesive dispensing valve adapted to be mounted on a valve operating module having an adhesive passageway providing fluid communication between a supply of adhesive and the valve, the adhesive dispensing valve comprising:

a valve stem having a first end adapted to be connected to the valve operating module, the valve stem including a first surface at a second end, and a second surface longitudinally displaced from the first surface a predetermined distance toward the first end of the valve stem;

a body adapted to be sealingly mounted to the one end of the valve module, the body having an inlet at one end in fluid communication with the adhesive passageway, an outlet at an opposite end, a central passageway receiving the valve stem and extending between the inlet and the outlet, a bore proximate the opposite end of the body, the bore intersecting the central passageway and receiving the valve stem, a first valve seat disposed in the bore and cooperating with the second surface on the stem to form a first valve, and a disk plate slidably mounted in the outlet of the opposite end of the nozzle body and receiving the second end of the valve stem, the disk have plate having a bore therethrough forming a second valve seat cooperating with the first surface on the valve stem to form a second valve; and a cap releasably mounted on the opposite end of the body for securing the disk plate to the body.

4. An adhesive dispensing valve adapted to be mounted on a valve operating module having an adhesive passage providing a fluid path from a supply of adhesive to the adhesive dispensing valve, the adhesive dispensing valve controlling the flow of adhesive through the valve in response to operating states of the valve operating module, the adhesive dispensing valve comprising:

a valve body;

a plate removably mounted to the valve body and having a bore therethrough forming a first valve seat;

a second valve seat located in the valve body intermediate the first valve seat and an end of the valve adapted to be mounted to the valve operating module;

a valve stem extending through the second valve seat, the valve stem having a first end adapted to be connected to the valve operating module, a first surface near a second end of the valve stem and mating with the first valve seat for controlling the flow of adhesive in response to the operating states of the valve operating module, and a second surface intermediate the ends of the valve stem for mating with the second valve seat; and a coupling element disposed against the plate and connectable to the valve body for removably mounting the plate to the valve body.

5. The adhesive dispensing valve of claim 4 wherein the first surface and the first valve seat are shaped to form a needle-type valve.

6. The adhesive dispensing valve of claim 4 wherein the second surface and the second valve seat are shaped to form a ball-type valve.

7. The adhesive dispensing valve of claim 4 wherein the first surface of the valve stem sealingly engages the first valve seat in response to a first state of the valve operating module to terminate the flow of adhesive through the orifice, and the first surface of the valve stem disengages the first valve seat in response to a second state of the valve operating module to permit the flow of adhesive through the orifice.

8. The adhesive dispensing valve of claim 7 wherein the second surface of the valve stem moves to different positions relative to and disengaged from the second valve seat in response to both the first and the second states of the valve operating module.

9. The dispensing valve of claim 7 wherein the second surface of the valve stem sealingly engages the second valve seat in response to the first valve seat being moved out of sealing engagement with and away from the first surface of the valve stem, thereby terminating the flow of adhesive through the valve.

10. An adhesive dispensing valve adapted to be mounted on a valve operating module having an adhesive passage providing a fluid path from a supply of adhesive to the adhesive dispensing valve, the adhesive dispensing valve controlling the flow of adhesive through the valve in response to operating states of the valve operating module, the adhesive dispensing valve comprising:

a first valve in fluid communication with the supply of adhesive, the first valve passing adhesive therethrough in response to a first state of the valve operating module, and the first valve terminating the flow of adhesive therethrough in response to a second state of the valve operating module, the first valve including a removable plate having a bore therethrough forming a valve seat for the first valve; and a second valve located between the first valve and the supply of adhesive, the second valve passing adhesive therethrough in response to both of the first and second states of the valve operating module.

11. The adhesive dispensing valve of claim 10 wherein the second valve terminates the flow of adhesive therethrough in response to the second state of the valve operating module and a partial disassembly of the first valve.

12. The adhesive dispensing valve of claim 10 further comprising a mounting cap connectable to the adhesive dispensing valve for securing the removable valve plate to the adhesive dispensing valve.

13. The adhesive dispensing valve of claim 10 wherein the removable plate comprises:

a body having the bore extending therethrough, the bore including a first cavity disposed within the body and having a wider end directed toward one side of the body and in fluid communication with the adhesive passage way, and the first cavity being shaped to receive a valve stem;

a second cavity disposed within the body and shaped to form the valve seat receiving one end of the valve stem, the second cavity having a wider end intersecting a narrower end of the first cavity, and a narrower end in fluid communication with a dispensing orifice on an opposite side of the body; and a mounting flange extending laterally from the body.

14. The valve plate of claim 13 wherein the body is generally cylindrical.

15. The valve plate of claim 13 wherein the first cavity is generally conically shaped.

16. The valve plate of claim 13 wherein the second cavity is generally conically shaped.

17. The valve plate of claim 13 wherein the mounting flange has a first side contiguous with the one side of the body;

a second side opposite the first side; and a projection extending outwardly from the second side, the projection adapted to provide a seal between the mounting flange and a cap engaging the projection for securing the plate to the adhesive dispensing valve.

18. The valve plate of claim 17 wherein the projection is an annular ring on the second side of the mounting flange of the plate.

19. The valve plate of claim 17 wherein the plate further comprises a cylindrical dispensing channel connecting the narrower end of the second conically shaped cavity and the dispensing orifice.

20. The valve plate of claim 17 wherein the plate further comprises a cylindrical inlet channel extending between the wider end of the first conically shaped cavity and the one side of the body.

21. The adhesive dispensing valve of claim 10 further comprising:

a valve stem having a first body section having a first end adapted to be connected to the valve operating module;

a second body section having a smaller cross-section than the first body section;

a conical body section having a first end connected to a first end of the second body section, the conical body section having an outer conical surface tapering toward a second end, the conical body section adapted to form the first valve within the dispensing valve for passing adhesive therethrough as a function of operating states of the valve operating module; and a transitional body section connected between a second end of the first body section and a second end of the second body section, the transitional body section having a continuous curvilinear surface joining the first and second body sections, the transitional body section adapted to form the second valve within the dispensing valve for passing adhesive therethrough independent of the operating states of the valve operating module.

22. The valve stem of claim 21 wherein the transitional body section has a longitudinal profile generally in an S-shape extending between the second end of the first body section and the first end of the second body section.

23. The valve stem of claim 21 wherein the first outer surface is a generally cylindrical surface having a first diameter, and the second outer surface is a generally cylindrical surface having a second diameter smaller than the first diameter.

24. The adhesive dispensing valve of claim 10 further comprising a valve body having a shaft including an internal bore extending longitudinally a full length of the shaft and adapted to receive the a valve stem;

a first end adapted to extend into the adhesive passage of the valve operating module, wherein the internal bore intersects the adhesive passage, a second end opposite the first end and having a cavity disposed longitudinally in the second end and having an arcuate transition with the internal bore to form the valve seat, a first outer surface extending longitudinally along the second end, and a coupling component adapted to secure a mounting cap to the shaft; and a mounting element located on the shaft between the first and the second ends and adapted to mount the body to the valve operating module.

25. The valve body of claim 24 wherein the first outer surface includes a seal for sealing the first end within the adhesive passageway of the valve operating module.

* * * * *

UNITED STATES PATENT AND TRADEMARK OFFICE

CERTIFICATE OF CORRECTION

PATENT NO. : 5,598,974
DATED : February 4, 1997
INVENTOR(S) : William A. Lewis, et al.

It is certified that error appears in the above-indentified patent and that said Letters Patent is hereby corrected as shown below:

In the claims:

Column 8, line 62, delete "nozzle".

Column 9, line 38, delete "disk".

Column 9, line 40, delete "disk have".

Column 9, line 45, delete "disk".

Column 10, line 63, delete "way".

Column 12, line 25, delete "the".

Column 12, line 43, delete "passageway" and insert therefor --passage--.

Signed and Sealed this

Ninth Day of December, 1997

Bruce Lehman

*Attest:*

BRUCE LEHMAN

*Attesting Officer*

*Commissioner of Patents and Trademarks*